US006561547B2

(12) United States Patent
Attia et al.

(10) Patent No.: US 6,561,547 B2
(45) **Date of Patent: *May 13, 2003**

(54) MACHINE FEEDABLE ENVELOPE

(75) Inventors: Omar S. Attia, Lakeview, NY (US); Blaine Jackson, East Aurora, NY (US); Andre Saint, Tonawanda, NY (US); Brett Ulrich, South Wales, NY (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/755,794

(22) Filed: Jan. 5, 2001

(65) Prior Publication Data

US 2002/0089174 A1 Jul. 11, 2002

(51) Int. Cl.[7] ..... B42D 15/00

(52) U.S. Cl. ..... 283/116; 283/101; 283/117; 281/38; 281/56; 462/64; 462/65; 229/301

(58) Field of Search ..... 283/101, 116, 283/117; 281/38, 56; 462/64, 65; 229/301

(56) References Cited

U.S. PATENT DOCUMENTS

| | | | | | |
|---|---|---|---|---|---|
| 2,180,551 | A | * | 11/1939 | Sawdon et al. | 281/3 |
| 3,419,286 | A | * | 12/1968 | Noonan et al. | 282/11.5 |
| 3,941,309 | A | * | 3/1976 | Gendron | 229/73 |
| 4,084,696 | A | * | 4/1978 | Katz | 283/56 |
| 4,375,868 | A | * | 3/1983 | Slotar et al. | 229/92.3 |
| 4,406,647 | A | * | 9/1983 | Foffel | 229/69 |
| 4,842,303 | A | * | 6/1989 | Molenda | 281/38 |
| 5,230,501 | A | * | 7/1993 | Melton | 270/41 |
| 5,590,912 | A | * | 1/1997 | Stevens | 283/56 |
| 5,640,835 | A | * | 6/1997 | Muscoplat | 53/569 |
| 5,826,914 | A | * | 10/1998 | Hudetz | 283/61 |
| 5,913,725 | A | * | 6/1999 | Goldring | 283/100 |
| 6,126,201 | A | * | 10/2000 | Pace et al. | 281/29 |
| 6,149,205 | A | * | 11/2000 | Attia et al. | 283/116 |
| 6,173,888 | B1 | * | 1/2001 | Fabel | 229/71 |
| 6,276,724 | B1 | * | 8/2001 | Zorn | 283/56 |
| 6,402,022 | B1 | * | 6/2002 | Fabel | 229/303 |
| 6,409,075 | B1 | * | 6/2002 | Mehta et al. | 229/92.1 |
| 6,427,905 | B1 | * | 8/2002 | Flynn et al. | 229/75 |
| 6,450,399 | B1 | * | 9/2002 | Attia et al. | 281/38 |
| 2002/0088847 | A1 | * | 7/2002 | Attia et al. | 229/68.1 |

* cited by examiner

*Primary Examiner*—A. L. Wellington
*Assistant Examiner*—Mark T. Henderson
(74) *Attorney, Agent, or Firm*—Oppenheimer Wolff & Donnelly LLP

(57) ABSTRACT

An envelope sheet assembly for securing into a brochure or binder includes multiple sheets overlying one another so that the assembly is of uniform thickness to facilitate printing thereon. The envelope sheet assembly is preferably 8½ inches by 11 inches in size, and the envelope is preferably 11 inches by 4½ inches. Permanent pressure sensitive adhesive is employed to hold the sheets together and to form the envelope. The adhesive is also applied to the sealing flap, with a removable strip coated with a suitable release agent (i.e. silicone) protecting the adhesive coated flap. Perforations permit easy removal of the envelope from the assembly. The perforations can have a cut and tie pattern wherein the ties attach the envelope to the sheet assembly. The sheet assembly frames the envelope at all outside edges of the envelope or some of the outer edges of the sheet assembly can form outer edges of the envelope.

33 Claims, 5 Drawing Sheets

MACHINE FEEDABLE ENVELOPE

RELATED APPLICATIONS

This application is related to U.S. Pat. No. 6,149,205 issued on Nov. 21, 2000.

FIELD OF THE INVENTION

This invention relates to mailer envelope sheets for use alone or for inclusion in a brochure, catalog, booklet, binder or the like.

BACKGROUND OF THE INVENTION

It has previously been proposed to include return mailer envelopes in brochures, see R. E. Katz U.S. Pat. No. 4,084,696 granted Apr. 18, 1978. However, the '696 envelope sheet has certain drawbacks. For example, it has an envelope portion which is double thickness, while the remainder of the sheet is a single thickness of paper. For stacking and printing on sheets of paper, it is important that the paper be of uniform thickness to provide regular stacking and to avoid jamming of the copier. In addition, the '696 patent has exposed adhesive which could be activated under high humidity or damp conditions. With exposed activated adhesive, sheets may stick together and laser or ink jet printers may jam or become contaminated.

Prior art envelope sheet assemblies also fail to adequately protect the envelope during printing, binding and transportation. In prior art assemblies, envelope edges and corners are exposed and can become caught in machinery and bent or torn. Also, the envelope can take on a worn appearance after repeated flipping-through of the article into which it is bound.

SUMMARY OF THE INVENTION

Accordingly, it is a principal object of the present invention to provide an envelope sheet assembly for securing in a brochure, magazine, or the like, which has no exposed adhesive, and which will readily feed through high speed printers without jamming or contamination. It is a further object of the present invention to provide an envelope sheet assembly in which the outside edges and corners of the envelope are protected.

In one illustrative embodiment of the invention, the envelope sheet assembly is formed of two layers and is of substantially uniform thickness for high speed printing, includes an envelope with a length greater than 8½ inches and a width greater than 4 inches for conveniently receiving a standard 8½×11 inches or an A-4 sheet folded three times, a pressure sensitive strip forming the closure flap of the envelope, with the pressure sensitive adhesive being covered by a removable strip forming part of said assembly, and with the sheet assembly being provided with perforations for permitting easy removal of said envelope from the rest of said sheet assembly. It is noted that the dimensions given above are for standard size 8½ inches by 11 inches, or A-4, sheets included in brochures, and for brochures or the like having different dimensions, the two layer envelope assembly would be correspondingly modified in its dimensions.

The sheet assembly may also include one or more of the following additional features: (1) an envelope which is approximately 11 inches long; (2) the envelopes may be approximately 4 inches to 5 inches in height; (3) an envelope which is sealed at the bottom and two sides with permanent glue or adhesive, preferably permanent pressure sensitive adhesive; (4) the individual sheets making up the two layer sheet assembly may be formed of fairly lightweight paper so that the sheets may be semi-translucent or semi-transparent; and (5) the inside surfaces of the envelope may be provided with a printed pattern to preclude reading enclosures through the envelope.

The sheet assembly may also frame the envelope at all outside edges of the envelope. Perforations passing through the layers forming an envelope form a cut and tie pattern wherein the ties attach the envelope to the sheet assembly. The layers are held together and the envelope is held together by adhesive coating the outer edge areas of the sheets and extending into an area within the outer edges of the envelope.

Other objects, features and advantages of the invention will become apparent from a consideration of the following detailed description and from the accompanying drawings.

DETAILED DESCRIPTION OF PREFERRED EMBODIMENTS

Figure 1:
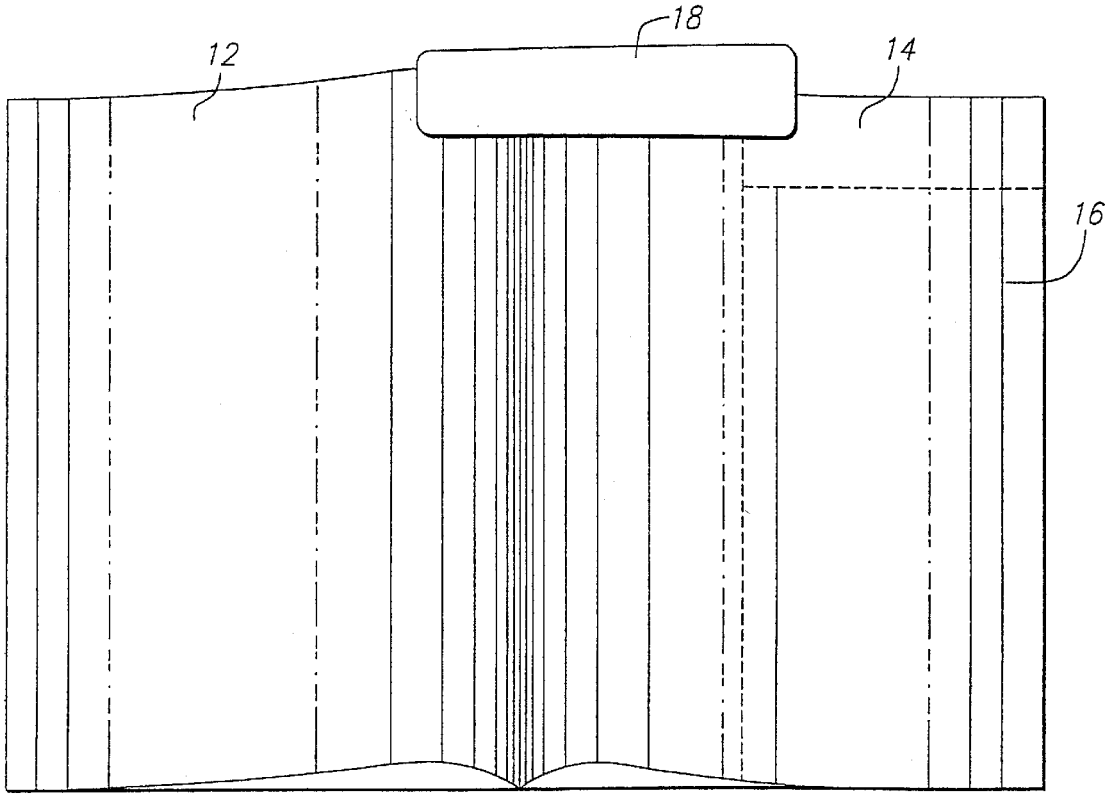
FIG. 1 shows a brochure which includes a two layer envelope sheet assembly bound into the brochure, and showing the rear side of the envelope.

Referring more particularly to the drawings, FIG. 1 shows a brochure or binder 12 including a two layer envelope sheet assembly 14. In FIG. 1, the back of the envelope 16 is shown.

Figure 2:
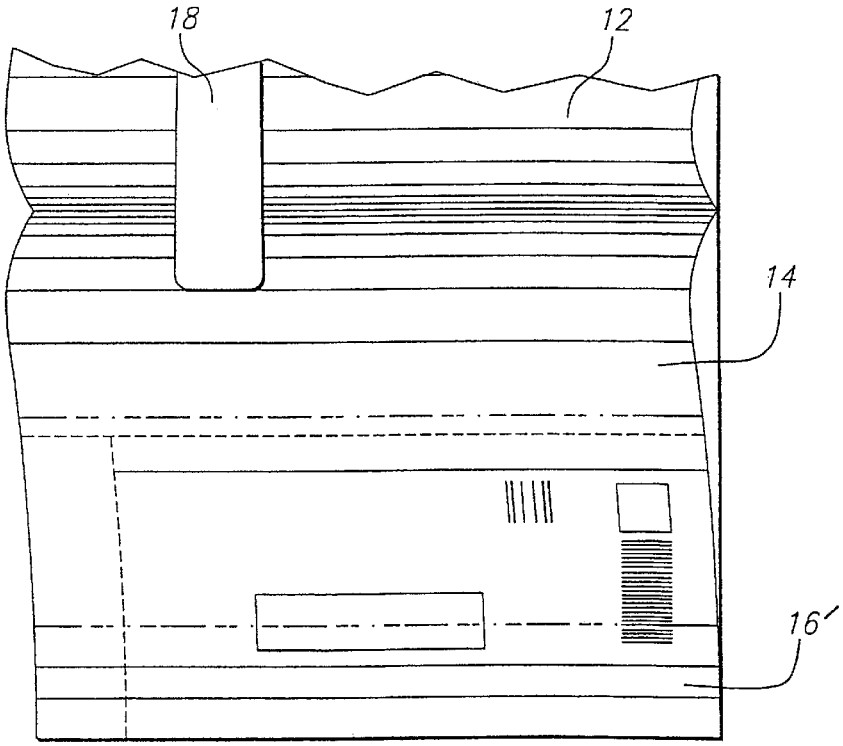
FIG. 2 shows the front side of the envelope forming part of the two layer sheet assembly bound into the brochure.

In FIG. 2 the front 16' of the envelope is shown, with the two layer envelope assembly 14 being turned as one page in the brochure or binder 12.

In both FIGS. 1 and 2, a stapler 18 is shown, to hold the brochure open.

Figure 3:
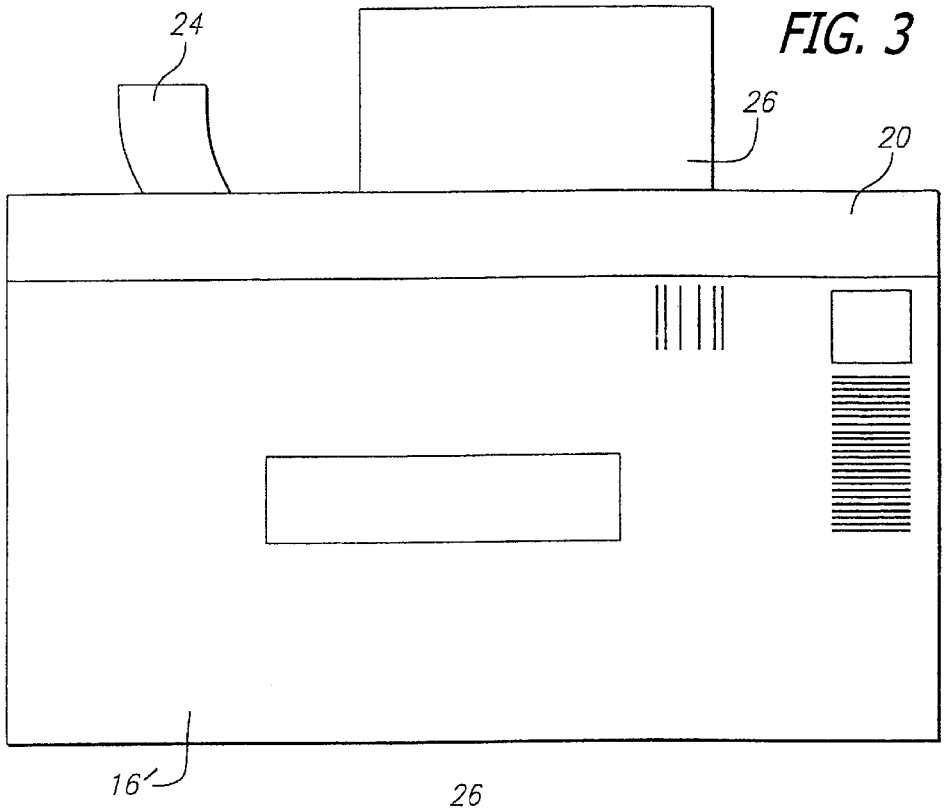
FIG. 3 shows the front of the envelope following detachment from the rest of the two layer sheet assembly.

Turning now to FIG. 3, the front 16' of the envelope is shown. At the top of the envelope is the sealing flap 20. The rear of the sealing flap 20 is coated with pressure sensitive adhesive, in the area designated by the reference numeral 22 in FIG. 4. The strip of paper 24, shown partially peeled back in FIGS. 3 and 4, protects the pressure sensitive adhesive, and is peeled off when the user seals the envelope. In practice, a thin release layer, for example silicone, is provided between the strip 24 and the pressure sensitive adhesive to permit easy removal of the strip.

Figure 4:
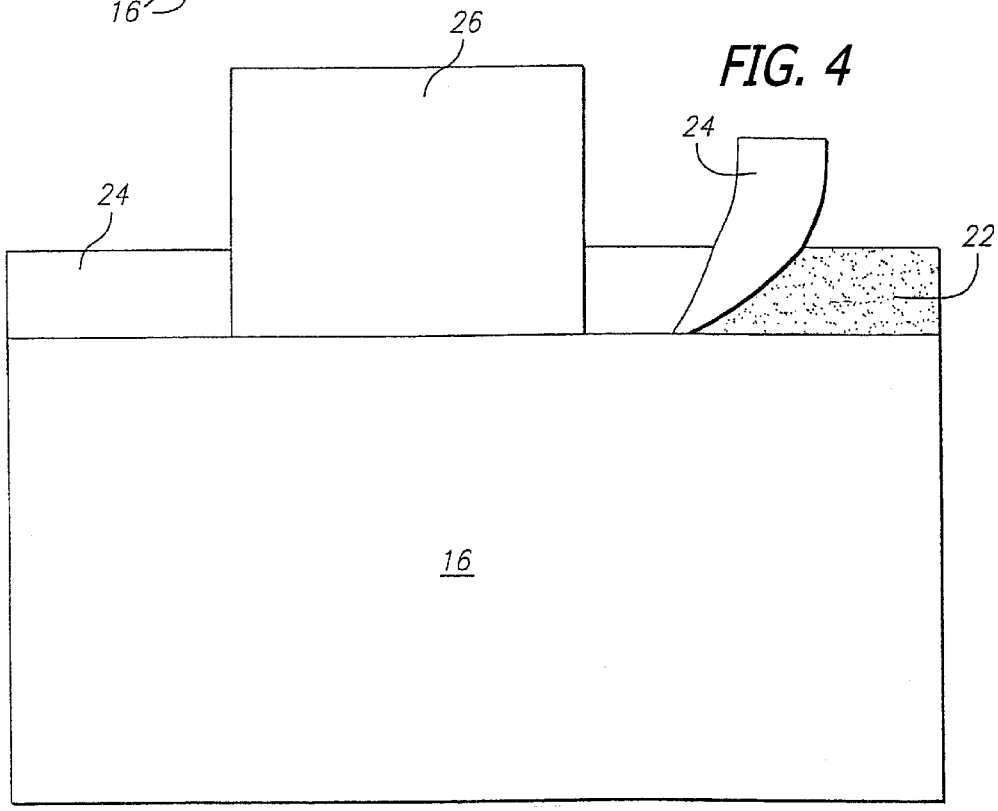
FIG. 4 shows the back of the envelope of FIG. 3.

A folded sheet of paper 26 is shown partially extending into the envelope 16 in FIGS. 3 and 4 to show the location of the opening of the envelope.

Consideration will now be given to FIG. 5 in which the complete two layer envelope assembly 14 is shown, with the back of the envelope 16 being visible. Perforations 30 through both layers of the two layer sheet assembly permit easy removal of the envelope 16 from the remainder 32 of the two layer sheet assembly 14.

Figure 5:
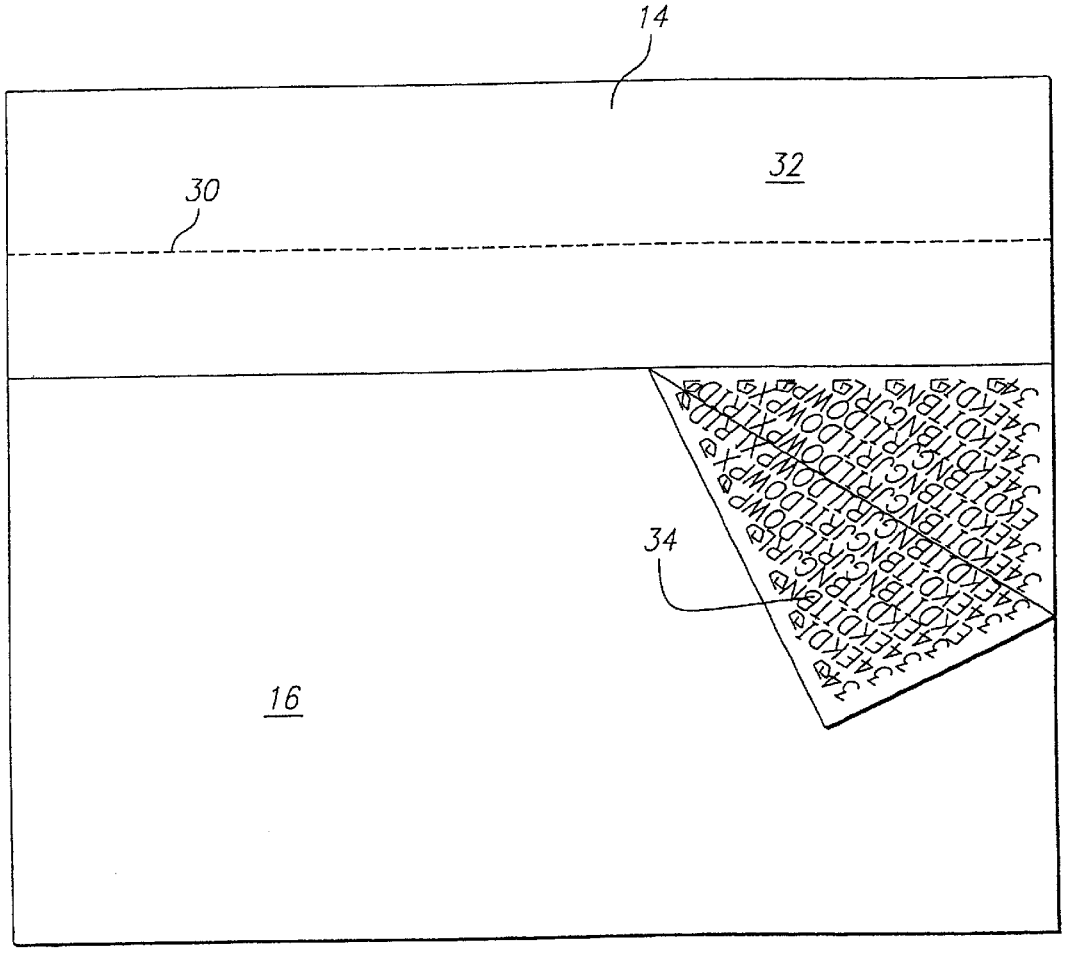
FIG. 5 shows a full two layer sheet assembly with the envelope partially pulled open.

In FIG. 5, one corner 34 of the envelope pocket has been pulled down, exposing the printed pattern on the inside of the layer. For easy printing using xerographic or ink jet printers, it is desirable that the two layer sheet assembly be relatively thin and flexible. As a result, the paper forming the front and back of the envelope may be semi-translucent or semi-transparent, so the printed pattern is useful to preclude reading of material enclosed within the envelope. By way of example, 20 pound paper may be used for each sheet of the two sheet assembly. When the term "20 pound paper" is used, it means that 500 sheets of paper 17 inches by 22 inches in size, weighs 20 pounds.

Concerning dimensions, each of the sheets of the two layer envelope assembly may be 8½×11 inches, or A-4 size paper. The bottom and two sides of the envelope are bonded together by permanent adhesive, which may be the same pressure sensitive adhesive used on the sealing flap of the envelope. Incidentally, while any pressure sensitive adhesive may be used, rubber based, hot melt permanent pressure sensitive adhesive is preferred. The envelopes are preferably 11 inches in length and between 4 and 5 inches, preferably about 4½ inches, in height. As an alternative, the envelopes may be made somewhat smaller in length by providing perforated tear-off portions at one end of the envelope area, and correspondingly shifting the glue or adhesive line; but the size of the envelope pocket should be maintained large enough to easily accommodate 8½×11 inches, or A-4 paper, folded three times. Thus, a height of at least 4 inches and a length of at least 9 inches for the envelopes is desired.

FIGS. 1–5 represent an "edge-cut" envelope construction. In the "edge-cut" embodiment, several sides of the envelope 16 are formed by edges of the envelope assembly 14. The envelope 16 is formed at an outer edge of the envelope sheet assembly 14 and extends inwardly towards the brochure or binder.

Figure 6:
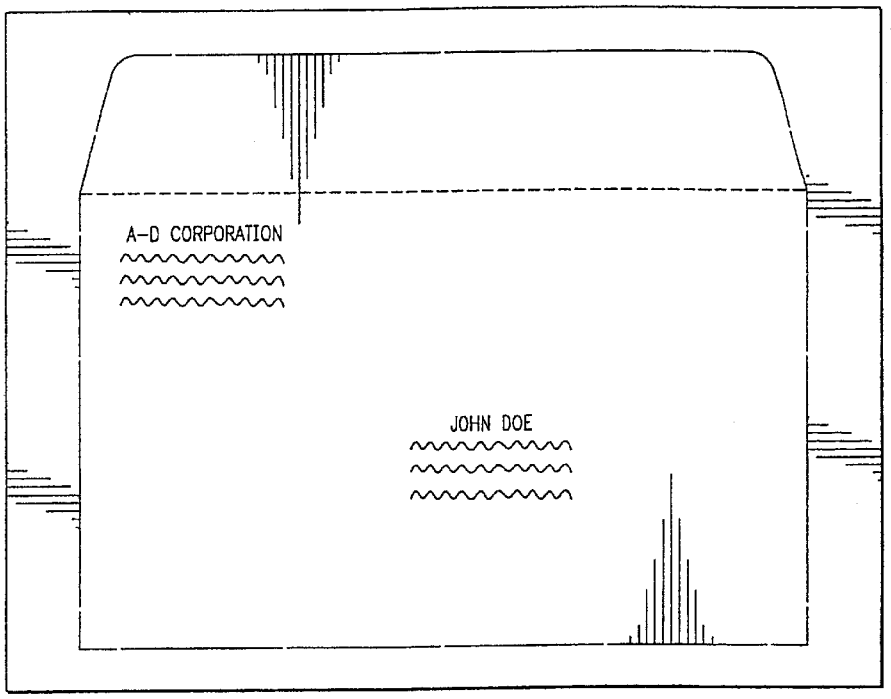
FIG. 6 shows a "center-cut" embodiment of the two layer sheet assembly.
Figure 7:
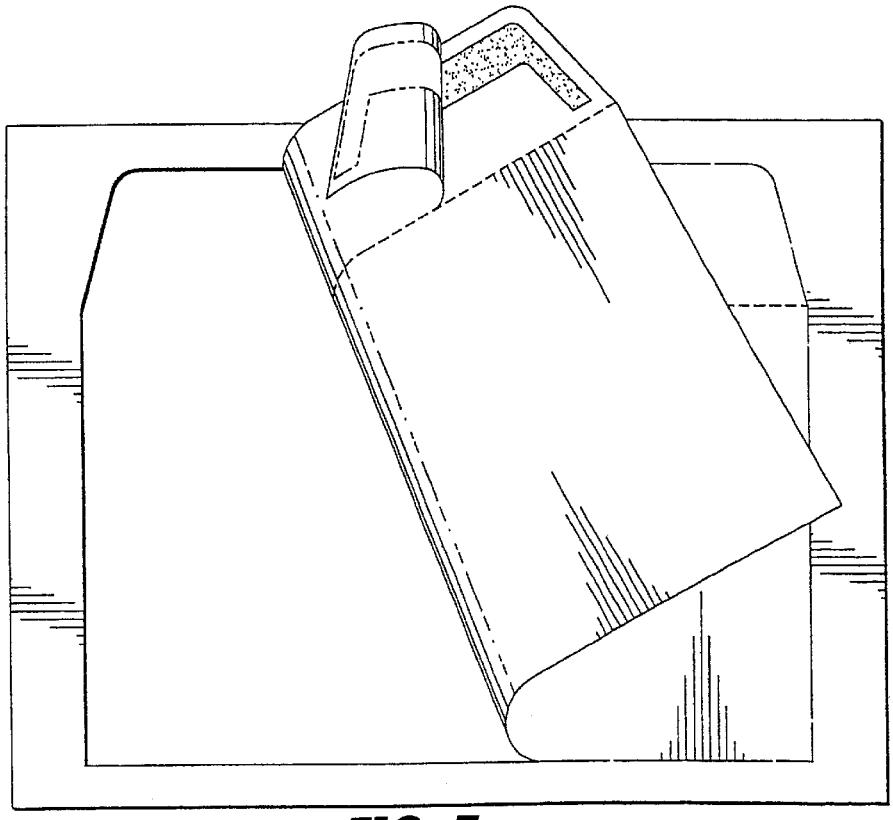
FIG. 7 shows the embodiment of FIG. 6 with the envelope partially removed and the liner strip partially peeled off from the flap.
Figure 8:
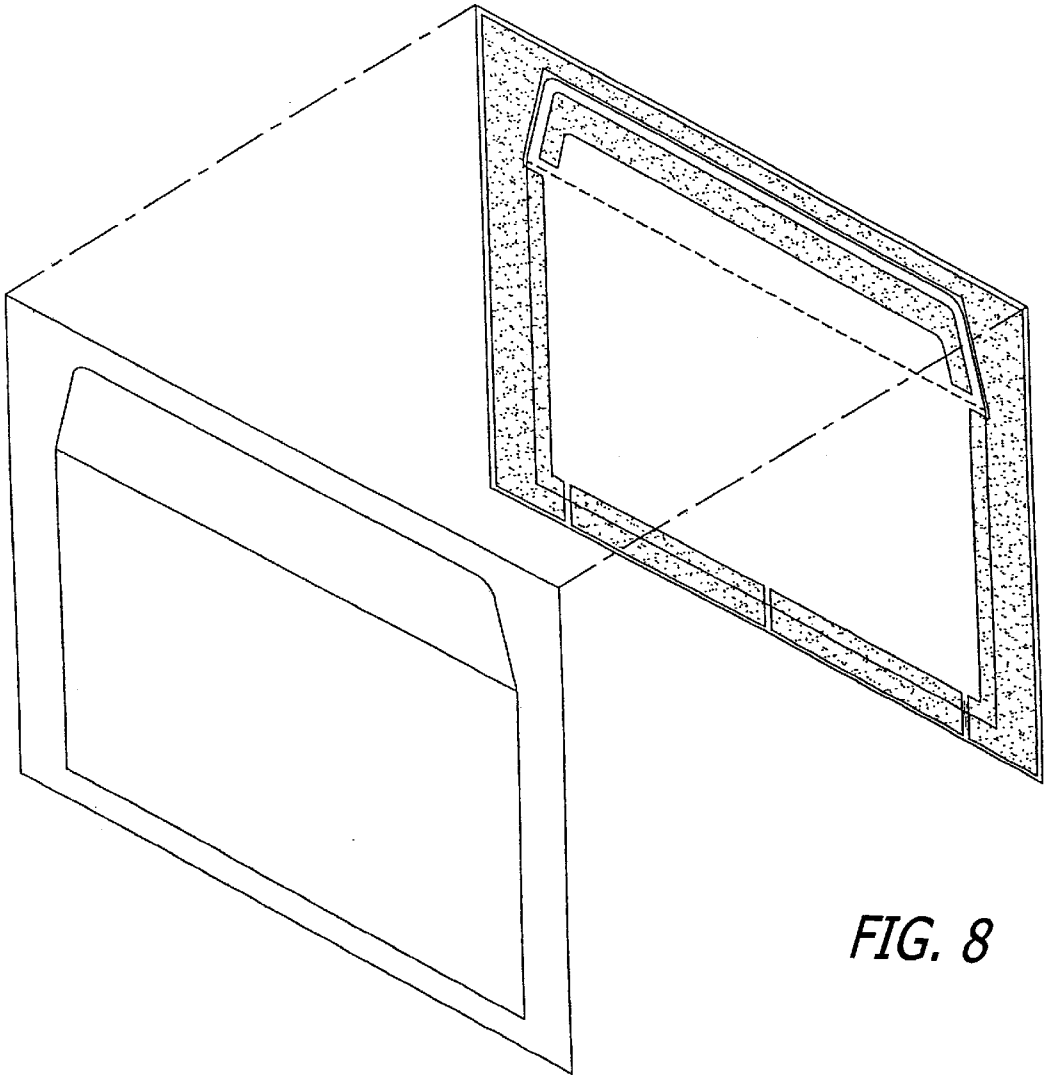
FIG. 8 shows an exploded view of the "center-cut" embodiment of FIG. 6.

In FIGS. 6–8, however, a two layer envelope sheet assembly 40 is disclosed wherein the assembly includes a "center-cut" envelope 42 in which all outer edges 50 of the envelope 42 are formed by perforations 44 cut into the envelope assembly 40. Thus, the envelope sheet assembly 40 frames the envelope 42 at all outer edges 50. This "center-cut" embodiment provides better protection for the outer edges of the envelope 16, as compared with the "edge-cut" construction. More specifically, the envelope assembly 40 protects the envelope outside corners and edges from tearing or fraying during binding or printing, for example.

Referring to FIG. 6, the envelope assembly 40 can be bound into the binder 12 along any of the envelope assembly outside edges 46. The envelope 42 is "center-cut" into the envelope assembly 40. The perforations 44 are in the form of a series of cuts 47 and ties 48 allowing easy removal of the envelope 42 from the envelope assembly 40. At the same time the ties 48 hold the envelope to the envelope assembly 40 securely enough to prevent accidental disengagement of the envelope 42 when feeding the envelope assembly 40 through high speed printers or when handling the brochure or binder 12 into which the envelope assembly 40 has been bound. The ties 48 may extend 1/32 inch along the envelope outside edges 50. A strip, closure flap or sealing flap 52 is formed at the top of the envelope 42. The flap 52 has a score or fold line 54 to allow the sealing flap 52 to be easily folded down along the score line 54 when sealing the envelope 42.

FIG. 7 shows the envelope 42 partially removed from the envelope assembly 40. A hole is left in the remainder of the envelope assembly 40 once the envelope 42 has been removed. The rear of the sealing flap 52 is coated with pressure sensitive adhesive, in the area designated by the reference numeral 56. A liner strip 58, shown partially pealed back, protects the pressure sensitive adhesive, and is peeled off when the user seals the envelope. The liner strip is peeled off along the perforation line 62. In practice, a thin release layer 60, for example silicone, is provided between the strip 58 and the pressure sensitive adhesive to permit easy removal of the strip.

FIG. 8 is an exploded view of the envelope assembly 40. The envelope assembly 40 is made from a front sheet 64 and a back sheet 66. The outer edge area of the second sheet 66, designated by the reference numeral 68, is coated with patterned pressure sensitive adhesive. The corresponding outer edge area of the front sheet 64 is also coated with pressure sensitive adhesive so that the two sheets 64, 66 can be secured together. The patterned pressure sensitive adhesive is recessed on all sheet edges to prevent the adhesive from contaminating the copier, printer or the like. The outer edge area 68 that is coated with adhesive extends from the outer edges of the assembly across the perforations 44 to the area within edges 50 of the envelope 42. In this way, the envelope 42 is sealed on three sides and the envelope assembly 40 is secured on four sides.

What is claimed is:

1. A multi-layer envelope sheet assembly for securing in a brochure or magazine or binder, comprising:

front and back sheets of paper held together by a pressure sensitive adhesive forming an envelope sheet assembly;

said assembly using standard size approximately 8½×11 inch sheets including A4 size paper sheets;

perforations passing through the front and back sheets forming an envelope removable from the envelope sheet assembly;

said envelope being more than 8½ inches long and more than 4 inches wide; a pressure sensitive adhesive-coated strip formed from the front sheet and forming a closure flap of the envelope, the flap and pressure sensitive adhesive being covered by a removable release coated strip formed from the back sheet;

and the envelope framed by the envelope sheet assembly at all outside edges of the envelope and sealed along three sides with pressure sensitive adhesive.

2. The multi-layer envelope sheet assembly of claim 1, wherein:

the perforations form a cut and tie pattern that includes ties and the ties attach the envelope to the envelope sheet assembly.

3. The multi-layer envelope sheet assembly of claim 1, wherein:

the front and back sheets are held together and the envelope is held together by pressure sensitive adhesive coating the outer edge areas of the sheets and extending into an area within the outer edges of the envelope.

4. A The multi-layer envelope sheet assembly of claim 1, further comprising:

a release layer formed on the removable strip and positioned between the pressure sensitive adhesive-coated strip and the removable strip.

5. The multi-layer envelope sheet assembly of claim 1, wherein:

the release layer is formed of a release agent.

6. An assembly, as defined in claim 1, further comprising a brochure, magazine or binder into which the front and back sheets are secured.

7. The multi-layer envelope sheet assembly of claim 1, wherein:

the envelope assembly is die-cut through the back sheet towards the front sheet, resulting line of perforations forming a base of the removable strip, and a score line at said base of the closure flap.

8. The multi-layer envelope sheet assembly of claim 1, wherein:

the envelope has a length greater than 8½ inches and a width greater than 4 inches for conveniently receiving a sheet 8½ inches by 11 inches, or an A-4 sheet folded three times.

9. An envelope sheet assembly as defined in claim 1 wherein said envelope is approximately 11 inches long, and is between 4 and 5 inches in height.

10. An envelope sheet assembly as defined in claim 1 wherein each of the sheets making up said assembly is of lightweight semi-transparent paper, and wherein the inner surfaces of said envelope have a bold printed pattern to preclude reading material contained in said envelope.

11. An assembly as defined in claim 1 further comprising a brochure, magazine or binder into which the envelope sheet assembly is mounted, said brochure or binder having additional pages having substantially the same size as said envelope sheet assembly.

12. An envelope sheet assembly as defined in claim 1 further comprising an address printed on said envelope.

13. An envelope sheet assembly as defined in claim 1 wherein said envelope is sealed along three sides thereof with permanent pressure sensitive adhesive.

14. The multi-layer envelope sheet assembly of claim 1, wherein:

the front and back sheets are of substantially uniform thickness for high speed printing on the envelope sheet assembly.

15. The multi-layer envelope sheet assembly of claim 1, wherein:

the envelope has dimensions, along both an x-axis and a y-axis, substantially less than the dimensions of the envelope sheet assembly.

16. The multi-layer envelope sheet assembly of claim 5, wherein:

the adhesive coating the outer edge areas of the sheets and extending into an area within the outer edges of the envelope has gaps allowing air to pass between an area inside and outside of the envelope and allowing air to escape from a pocket of the envelope.

17. A multi-layer envelope sheet assembly, comprising:

first and second sheets of paper held together by a pressure sensitive adhesive forming an envelope sheet assembly;

said assembly using standard size approximately 8½×11 inch sheets including A4 size paper sheets;

perforations passing through the first and second sheets forming an envelope removable from the envelope sheet assembly;

said envelope being more than 8½ inches long and more than 4 inches wide; a pressure sensitive adhesive-coated strip formed from the first sheet and forming a closure flap of the envelope, the flap and pressure sensitive adhesive being covered by a removable release coated strip formed from the second sheet;

and the envelope being framed by the envelope sheet assembly at all outside edges of the envelope and sealed along three sides with pressure sensitive adhesive.

18. An assembly, as defined in claim 17, further comprising a brochure, magazine or binder into which the first and second sheets are secured.

19. A multi-layer envelope sheet assembly for printing in a high speed printer, and applicable for securing in a brochure or magazine or binder, comprising:

front and back sheets of paper held together by pressure sensitive adhesive forming an envelope sheet assembly;

said assembly being formed of standard size approximately 8½×11 inch sheets including A4 size paper sheets;

said assembly consisting solely of two single sheets of paper;

perforations passing through the front and back sheets forming an envelope removable from the front and back sheets of paper;

said envelope being more than 8½ inches long and more than 4 inches wide;

a pressure sensitive adhesive-coated strip formed from the front sheet and forming a closure flap of the envelope, the flap and pressure sensitive adhesive being covered by a removable release coated strip formed from the back sheet;

said assembly being of constant thickness, and having smooth peripheral edges, in addition to being formed of standard sized sheets, for jam-free feeding through high speed printers;

said assembly being printed with laser toner ink, and additional pages bound together with said assembly.

20. A multi-layer envelope sheet assembly for printing in a high speed printer, comprising:

front and back sheets of paper held together by pressure sensitive adhesive forming an envelope sheet assembly;

said assembly being formed of standard size approximately 8½×11 inch sheets including A4 size paper sheets;

said assembly consisting solely of two single sheets of paper;

perforations passing through the front and back sheets forming an envelope removable from the front and back sheets of paper;

said envelope being more than 8½ inches long and more than 4 inches wide;

a pressure sensitive adhesive-coated strip formed from the front sheet and forming a closure flap of the envelope, the flap and pressure sensitive adhesive being covered by a removable release coated strip formed from the back sheet;

said assembly being of constant thickness, and having smooth peripheral edges, in addition to being formed of standard sized sheets, for jam-free feeding through high speed printers;

and said assembly being printed with laser toner ink.

21. The multi-layer envelope sheet assembly of claim 20, wherein:

the perforations form a cut and tie pattern that includes ties and the ties attach the envelope to the envelope sheet assembly.

22. The multi-layer envelope sheet assembly of claim 20, wherein:

the front and back sheets are held together and the envelope is held together by pressure sensitive adhesive coating the outer edge areas of the sheets and extending into an area within the outer edges of the envelope.

23. The multi-layer envelope sheet assembly of claim 20, further comprising:

a removable strip formed from the back sheet of paper and covering the adhesive coated strip.

24. The multi-layer envelope sheet assembly of claim 20, further comprising:

a release layer formed on the removable strip and positioned between the adhesive coated strip and the removable strip.

25. An assembly, as defined in claim 20, further comprising a brochure, magazine or binder into which the front and back sheets are secured.

26. The multi-layer envelope sheet assembly of claim 20, wherein:

the envelope assembly is die-cut through the back sheet towards the front sheet, resulting in a line of perforations forming a base of the removable strip and a score line at said base of the closure flap.

27. The multi-layer envelope sheet assembly of claim 20, wherein:

the envelope has a length greater than 8½ inches and a width greater than 4 inches for conveniently receiving a sheet 8½ inches by 11 inches, or an A-4 sheet folded three times.

28. An envelope sheet assembly as defined in claim 20, wherein said envelope is approximately 11 inches long, and is between 4 and 5 inches in height.

29. An assembly as defined in claim 20 further comprising a brochure, magazine or binder into which the envelope sheet assembly is mounted, said brochure or binder having additional pages having substantially the same size as said envelope sheet assembly.

30. An envelope sheet assembly as defined in claim 20, further comprising an address printed on said envelope.

31. A The multi-layer envelope sheet assembly of claim 22, wherein:

the adhesive coating the outer edge areas of the sheets and extending into an area within the outer edges of the envelope has gaps allowing air to pass between an area inside and outside of the envelope and allowing air to escape from a pocket of the envelope.

32. A multi-layer envelope sheet assembly for printing in a high speed printer, comprising:

front and back sheets of paper held together by adhesive forming an envelope sheet assembly;

said assembly being formed of standard size approximately 8½×11 inch sheets including A4 size paper sheets; said assembly consisting solely of two sheets of paper;

perforations passing through the front and back sheets forming an envelope removable from the front and back sheets of paper;

said envelope being more than 8½ inches long and more than 4 inches wide;

an adhesive-coated strip formed from the front sheet and forming a closure flap of the envelope;

said assembly being of constant thickness, and having smooth peripheral edges, in addition to being formed of standard sized sheets, for jam-free feeding through high speed printers;

and said assembly being printed with ink from a high speed laser or ink jet printer.

33. The multi-layer envelope assembly of claim 32, wherein:

said assembly is printed with ink jet printer ink.

* * * * *